US010923805B2

(12) United States Patent
Schaupmann et al.

(10) Patent No.: US 10,923,805 B2
(45) Date of Patent: Feb. 16, 2021

(54) ANTENNA ASSEMBLY FOR AN AIRCRAFT

(71) Applicant: Airbus Operations GmbH, Hamburg (DE)

(72) Inventors: Christian Schaupmann, Hamburg (DE); Markus Altmann, Hamburg (DE)

(73) Assignee: Airbus Operations GmbH

( * ) Notice: Subject to any disclaimer, the term of this patent is extended or adjusted under 35 U.S.C. 154(b) by 204 days.

(21) Appl. No.: 16/263,360

(22) Filed: Jan. 31, 2019

(65) Prior Publication Data

US 2019/0245264 A1 Aug. 8, 2019

(30) Foreign Application Priority Data

Feb. 7, 2018 (DE) ..... 10 2018 102 765

(51) Int. Cl.
*H01Q 1/28* (2006.01)
*H01Q 9/04* (2006.01)
*H01Q 1/08* (2006.01)

(52) U.S. Cl.
CPC ..... *H01Q 1/286* (2013.01); *H01Q 1/085* (2013.01); *H01Q 9/0407* (2013.01)

(58) Field of Classification Search
None
See application file for complete search history.

(56) References Cited

U.S. PATENT DOCUMENTS 8,523,854 B2 * 9/2013 Willyard ..... H01Q 9/16 606/33
2004/0150554 A1 8/2004 Stenger et al.
(Continued)

FOREIGN PATENT DOCUMENTS

DE 602004001041 T2 10/2006
DE 102009038150 A1 3/2011
(Continued)

OTHER PUBLICATIONS

British Examination Report for Application No. GB 1901402.6 dated Apr. 21, 2020, 3 pages.
(Continued)

*Primary Examiner* — Amy Cohen Johnson
*Assistant Examiner* — Jianzi Chen
(74) *Attorney, Agent, or Firm* — Lerner, David, Littenberg, Krumholz & Mentlik, LLP

(57) ABSTRACT

An aircraft antenna assembly has a support element having a first and a second surface on opposite sides, an antenna element arranged on or in the support element, and a sealing device. The first surface and the sealing device are configured such that the antenna assembly is arranged on an outer skin section of an aircraft such that the first surface faces the outer skin section, the sealing device is situated between the support element and the outer skin section, and a cavity is defined by the sealing device, the outer skin section and the first surface. The support element or the sealing device y has a flow channel having a first and a second opening at opposite ends, the flow channel connecting the cavity and the environment and opening into the cavity at the first opening and opening into the environment at the second opening.

15 Claims, 5 Drawing Sheets

(56) References Cited

U.S. PATENT DOCUMENTS

| | | | | |
|---|---|---|---|---|
| 2006/0274216 | A1* | 12/2006 | Katayama | H04N 7/163 348/731 |
| 2011/0122033 | A1* | 5/2011 | Sauer | H01Q 1/42 343/705 |
| 2011/0215985 | A1* | 9/2011 | Kaplan | H01Q 21/08 343/879 |
| 2011/0279343 | A1* | 11/2011 | Giovannelli | H01Q 21/0025 343/850 |
| 2016/0172745 | A1 | 6/2016 | Keen et al. | |
| 2017/0050717 | A1* | 2/2017 | Scimone | B64C 7/00 |
| 2018/0351243 | A1* | 12/2018 | Lewis | B64C 1/36 |
| 2019/0245264 | A1* | 8/2019 | Schaupmann | H01Q 1/085 |
| 2019/0326665 | A1* | 10/2019 | Juergens | H01Q 1/12 |

FOREIGN PATENT DOCUMENTS

| | | | |
|---|---|---|---|
| DE | 102016208726 | A1 | 11/2016 |
| EP | 2818416 | B1 | 9/2016 |

OTHER PUBLICATIONS

German Search Report for Application No. DE 10 2018 102 765.6 dated Oct. 28, 2019, 2 pages.

* cited by examiner

ANTENNA ASSEMBLY FOR AN AIRCRAFT

FIELD OF THE INVENTION

The present application relates to an antenna assembly for an aircraft, which has a support element and at least one antenna element arranged on or in the support element, and to an aircraft having an antenna assembly of this kind.

BACKGROUND OF THE INVENTION

Aircraft typically have one or more antennas, by means of which radio communications can be established between the aircraft and external devices or traffic on the ground or in the air, e.g. other aircraft or satellites.

In the prior art, antennas of this kind are in some cases mounted externally on the aircraft fuselage, with the result that they project a long way out from the aircraft fuselage into the air surrounding the fuselage. As a result, not only is the air resistance of the aircraft increased but aerodynamic forces act on the antennas, these tending to detach the antenna from the fuselage. Comprehensive measures must therefore be taken to reliably secure the antennas, and these measures are often complex and/or associated with high weight. For example, some antenna elements are secured on the fuselage by means of a base plate, which has a relatively high weight and projects into the ambient air together with the actual antenna element.

In other embodiments, antenna elements of such antennas have been integrated directly into the outer skin of the aircraft fuselage by providing them as a layer in a multi-layer outer skin. In the case of such antennas, however, maintenance work and subsequent replacement after manufacture is laborious.

BRIEF SUMMARY OF THE INVENTION

Aspects of the present invention may provide an antenna assembly for an aircraft which is of simple and low-cost construction, is easy to install and service and has a low weight, and to provide an aircraft which has an antenna assembly of this kind.

According to an embodiment of the present invention, an antenna assembly for an aircraft or of an aircraft is provided which has a support element having a first and a second surface on opposite sides of the support element, one or more antenna elements arranged on or in the support element, and a sealing device.

The first surface and the sealing device are configured in such a way that the antenna assembly can be arranged in such a way on an outer skin section of an aircraft that the first surface faces the outer skin section, that the sealing device is situated between the support element and the outer skin section and, in particular, is situated between the first surface and the outer skin section for example, and that one or more cavities is/are defined by the sealing device, the outer skin section and the first surface. In this case, the outer skin section, for example, can have a shape corresponding to the first surface, the shape of the first surface thus defining the shape of outer skin sections which are suitable for use with the specific support element and the specific antenna assembly. However, it is also possible, as an alternative or in addition, to achieve a match between the shape of the outer skin section and the shape of the first surface by means of the sealing device. In a preferred embodiment, further details of which will be given below, the support element and preferably the entire antenna assembly is/are flexible, however, and, in particular, in the form of a mat or film, thus enabling adaptation to various outer skin sections. Independently of this, the sealing device can have or be formed by one or more sealing elements, an adhesive material and/or a section of the support element, for example, these being adapted or provided to rest against an outer skin section.

If a plurality of cavities is provided, they are separated from one another after the arrangement of the support element on the outer skin section, making it impossible for air to flow between the various cavities. Sealing can be accomplished by means of the sealing device, for example.

The support element or the sealing device for each of the cavities has at least one flow channel having a first and a second opening at opposite ends of the flow channel, wherein each of such flow channels preferably extends through the support element or through the sealing device. Each of the flow channels is configured and arranged in such a way that it connects the corresponding cavity and the environment of the antenna assembly to one another after the arrangement of the antenna assembly on the outer skin section and that it opens into the corresponding cavity at the first opening and into the environment at the second opening. Thus, the first opening, which is preferably formed in the first surface, connects the respective cavity and the flow channel, thus allowing air to flow out of the cavity into the flow channel through the first opening. In a similar way, the second opening connects the flow channel and the environment of the antenna assembly, thus allowing air to flow out of the flow channel into the environment through the second opening. After the arrangement of the antenna assembly on the outer skin section, the cavity or cavities is/are sealed off by the sealing device in such a way that a flow of air out of the cavity or cavities is only possible through one of the flow channels assigned to the relevant cavity.

After the described arrangement of the support element on an outer skin section of an aircraft, this configuration of the antenna assembly ensures that there is a flow of air over the second openings of the flow channels while the aircraft is in flight, and the second openings act as suction openings, as in a jet pump, with the result that the corresponding flow channels act as suction channels, which produce in the corresponding cavities a reduced pressure which is lower than the ambient pressure and thus gives rise to a retaining force which holds the support element and the antenna assembly overall firmly on the outer skin and counteracts lifting forces due to aerodynamic forces. Since the latter lifting forces are produced by the same air flow which also produces the reduced pressure, and the reduced pressure is thus all the greater, the greater the aerodynamic effects which lead to the lifting forces, it is advantageously ensured that the antenna assembly automatically and passively counteracts the lifting forces. The retaining force has the overall effect of counteracting liftoff or prevents it automatically. In the case where the support element is of flexible design, in particular in the form of a flexible mat or film, as envisaged in a preferred embodiment, it is furthermore advantageously possible to counteract or prevent flapping. Overall, it is preferred if the flow channels and the second openings are arranged in such a way that, when air flows over the antenna assembly in a predetermined direction after the described arrangement on an outer skin section, the air flows over the second openings of all the flow channels. The antenna assembly is then preferably oriented in such a way on the outer skin section that, during the flight of the corresponding aircraft, the air flows over the antenna assembly in the predetermined direction. In particular, the predetermined direction can be oriented counter to the direction of flight.

In a simple manner, the cavities can be dimensioned, shaped and arranged in such a way that they cover a sufficient proportion of the first surface and suitable proportions of the first surface to ensure that the retaining force is adequate for the use envisaged. Since substantially static conditions prevail during operation, under which, to maintain the reduced pressure in the cavities, the only air which is still sucked out is that which enters the cavities through leaks, the volume of the cavities is of relatively little significance as compared with the surface coverage of the first surface by the cavities and the shape and distribution thereof.

The antenna assembly described has the advantage that it can be secured reliably and in a simple manner on the outer skin of an aircraft, e.g. the outer skin of an aircraft fuselage or some other part of the structure, e.g. a wing or a tailplane. In particular, it is possible to dispense with an adhesive joint or at least one large- or full-area adhesive joint and with fastening mechanisms, which have a high weight. Adhesive joints have the disadvantage that the compatibility between the adhesive material employed and the materials of the antenna assembly must be taken into consideration, considerably restricting the choice of materials since the materials must also satisfy additional requirements in respect of dielectric properties, material ageing, thermal stability, elasticity and thermal conductivity, for example. Moreover, large-area adhesive joints are difficult to maintain and repair, can hinder access to riveted joints underneath the antenna assembly, promote the occurrence of mechanical stresses in the antenna assembly during deformations occurring in the underlying outer skin during operation, can lead to blister formation or local lifting forces during the normal escape of air through the outer skin and are difficult to produce without air inclusions that impair their stability, for example. These disadvantages are avoided by the present antenna assembly.

All that is required is to connect the antenna assembly to the outer skin or secure it thereon in some region or regions, i.e. at only one or at a plurality of individual interspaced points or in relatively small sections, since the antenna assembly advantageously has a mechanism which, during flight, opposes the lifting forces produced during operation by the flow over the antenna assembly with a countervailing retaining force, which is likewise produced by the same flow. In this scenario, the retaining force increases with increasing flow velocity, just like the lifting force. Fastening can be accomplished, for example, by means of retaining clips which extend over the support element and are secured on the outer skin or on a reinforcing element, situated under the outer skin, of a reinforcing structure of the aircraft, or by means of an adhesive joint, which is then not a full-area adhesive joint.

It is furthermore possible to use flexible antenna elements and flexible antenna structures, for which a solution employing an adapter plate would lead to a disproportionately high weight.

Electric leads, electric terminals, earthing elements, shielding elements and/or waveguides are preferably arranged in or on the support element. They can, for example, be embedded in a material of the support element, e.g. a flexible film material, and/or can be arranged on the second surface.

In a preferred embodiment, a plurality of separate cavities is provided, ensuring that, if there is a leak affecting one cavity, leading to a reduction in or disappearance of the corresponding retaining force in the region of said cavity, the other cavity or cavities is/are not affected. As an alternative or in addition, it is preferred if there is a plurality of separate flow channels for each cavity, ensuring that there is redundancy for each cavity in respect of the flow channels and that, if one flow channel is blocked, for example, it is nevertheless still possible to produce a reduced pressure.

In a preferred embodiment, the second opening of one or more or all of the flow channels is formed on a line section in which part of the flow channel extends and which projects from the support element—and, in particular, from the second surface of the support element, for example—or the sealing device into the environment after the arrangement of the antenna assembly on the outer skin section. This embodiment has the advantage that it is a particularly simple matter to arrange the second opening selectively in a position and/or orientation in which the aerodynamic effects which cause the suction effect are sufficiently large or at a maximum when air flows over the antenna assembly.

In a preferred embodiment, which can be combined with the preceding embodiment, the second opening of one or more or all of the flow channels is formed in the second surface or the sealing device. If formed in the second surface, the second opening opens into the environment adjoining the second surface, or the second opening connects the environment and the flow channel, thus allowing air to flow out of the flow channel into the environment through the second opening.

In a preferred embodiment, the support element is a sheet-like element. In other words, it has two opposite extended surfaces which are spaced apart from one another in a thickness direction, wherein the thickness is very much less than the dimensions of the surfaces. The thickness can be 1 to 5 cm, for example. The support element can be of plate-shaped or mat- or film-shaped design. By virtue of the sheet-like design, the antenna assembly can advantageously be arranged on the outer skin without greatly increasing air resistance if the antenna assembly or antenna elements are integrated into the support element or designed in such a way that they do not project significantly or at all from the second surface of the support element. The latter possibility can be achieved, for example, by printing the antenna elements onto the support element or by providing them as conducting tracks or conductive coatings on the support element in some other way.

In a preferred embodiment—and especially in embodiments in which the support element is a sheet-like element in the described way—the support element and, as a result, preferably the entire antenna assembly is flexible. In this case, the flexibility can preferably be present over the entire support element or the entire antenna assembly or at least along at least one direction along the first surface. However, it is also conceivable for the support element or the antenna assembly to be of flexible design in some section or sections. The support element can preferably comprise a flexible material, e.g. a flexible plastic material, which is film- or mat-shaped and in which the antenna elements are embedded or on which the antenna elements are secured or onto which they are printed. The support element is then preferably mat- or film-shaped as a whole and is, for example, a film and, in particular, a film component or has a film and, in particular, a film component. It should be noted that, overall and also in this embodiment, it is possible when the support element is of flexible configuration for a reinforcing structure to be provided in the support element, this reinforcing structure being arranged in such a way that loads which occur during operation are transmitted to particular points or regions of the support element, which can then be used as fastening points for fastening the support element on the outer skin or on an underlying reinforcing structure. However, a reinforcing structure does not have to be present.

In a preferred embodiment—which can, in particular, be combined with the embodiments described, in which the support element is flexible and preferably sheet-like—the first surface has one or more recesses, each of which at least partially or, preferably, completely defines one of the cavities after the arrangement of the antenna assembly on the outer skin section. By virtue of the recesses, the cavities are defined after arrangement on an outer skin section, even if the first surface rests against the outer skin outside the recesses, wherein, if appropriate, the sealing device can additionally be arranged between the first surface and the outer skin. The antenna assembly of the present invention can then be defined as follows, even independently of arrangement on the outer skin: the antenna assembly for an aircraft or of an aircraft has a support element having a first and a second surface on opposite sides of the support element, one or more antenna elements arranged on or in the support element, and a sealing device. The sealing device is in contact with the support element and preferably with the first surface or can be brought into contact therewith. The first surface has the one or more recesses. For each of the recesses, the support element or the sealing device has at least one flow channel having a first and a second opening at opposite ends of the flow channel, wherein each such flow channel preferably extends through the support element or through the sealing device. Each of the flow channels is configured and arranged in such a way that it connects the corresponding recess and the environment of the antenna assembly away from the recess or on another side of the support element to one another and that it opens at the first opening into the corresponding recess and opens at the second opening into the environment away from the recess. Thus, the first opening, which is preferably formed in the first surface, connects the respective recess and the flow channel, thus allowing air to flow out of the recess into the flow channel through the first opening. In a similar way, the second opening connects the flow channel and the environment of the antenna assembly, thus allowing air to flow out of the flow channel into the environment through the second opening, even if the corresponding recess is covered or sealed in an airtight manner. This description also applies to all other structural configurations which are described herein. The antenna assembly thus described can be arranged on an outer skin section of an aircraft in the manner described.

In a preferred further configuration of an antenna assembly, in which the support element is flexible in the manner described and in which the support element has one or more recesses in the first surface in the manner described, the support element has a rigid or stiff insert for each of the recesses, said insert defining the respective recess. In other words, the wall of the respective recess is formed by the insert. They ensure that the cavities or recesses have predetermined shapes and dimensions, even in use, despite the flexible configuration of the support element. This configuration is particularly advantageous for embodiments in which the support element comprises a flexible material which is film- or mat-shaped and in which the antenna elements are embedded or on which the antenna elements are secured.

In a preferred embodiment, each of the antenna elements is a patch antenna and/or a Ku or Ka antenna. In the case of antennas which operate in the millimetre range, the present invention has the particular advantage in that local deformations or flapping can be reliably prevented, something that otherwise considerably impairs antenna functioning in the case of such antennas.

In a preferred embodiment, each of the at least one antenna elements is printed onto the support element or onto a part thereof, especially in the case where the support element is sheet-like and flexible and preferably is or has a film or a film component.

In a preferred embodiment, the second surface has at least one raised portion, in which at least one electric lead and/or at least one fastening element is arranged or which is formed by at least one electric lead and/or at least one fastening element. The second opening of at least one of the flow channels is arranged on the raised portion or directly adjacent to the raised portion. For example, a projecting line section, on the end of which the second opening is situated, can be arranged or extend directly adjacent to the raised portion. High local pressures arise in the incident flow direction at the raised portions, and therefore aerodynamic effects can be particularly powerful in the region of the raised portions, exerting a positive influence on the suction effect at the two openings.

In a preferred embodiment, one or more thermally or electrically conductive elements, each of which forms part of the first surface or projects from the first surface, is/are provided on or in the support element, with the result that the thermally or electrically conductive elements are in contact with the outer skin after the arrangement of the support element on the outer skin. In this way, it is possible to exchange heat and electricity between the outer skin and the antenna assembly.

In a preferred embodiment, the antenna assembly furthermore has an outer skin section of an aircraft, which then corresponds to the outer skin section described above. The support element is accordingly arranged on the outer skin section in such a way that the first surface faces the outer skin section, the sealing device is situated between the support element—in particular the first surface, for example—and the outer skin section, and the at least one cavity is defined by the sealing device, the outer skin section and the first surface.

In this embodiment, it is furthermore preferred if one or more holes, through which cables are passed or can be passed, is/are provided in the outer skin, wherein the holes are arranged outside that region of the outer skin which is covered by the support element or the antenna assembly. This configuration has the advantage that the requirements as regards pressure tightness of the openings after cables have been passed through are lower. In the case of arrangement under the support element, it would be necessary to ensure that no air escaped through the openings into one of the cavities.

As an alternative or in addition, it is furthermore preferred in this embodiment if a recess, in which the antenna assembly is arranged, is provided in the outer skin section. This can preferably be performed in such a way that the second surface is flush with regions of the outer skin at the edge of the recess.

According to an embodiment of the present invention, an aircraft having an outer skin and an antenna assembly according to one of the embodiments described above is also provided, wherein the outer skin section described above is then a section of the outer skin of the aircraft. Accordingly, the support element is arranged in such a way on the outer skin section that the first surface faces the outer skin section, the sealing device is situated between the support element—in particular the first surface, for example—and the outer skin section, and the at least one cavity is defined by the sealing device, the outer skin section and the first surface. The antenna assembly is configured, arranged and oriented in such a way that the suction effect is achieved by the flow of air over the antenna assembly at the second openings in the manner described.

BRIEF DESCRIPTION OF THE DRAWINGS

The invention is explained in greater detail below with reference to the figures, in which two illustrative embodiments are illustrated.

DETAILED DESCRIPTION

Figure 1:
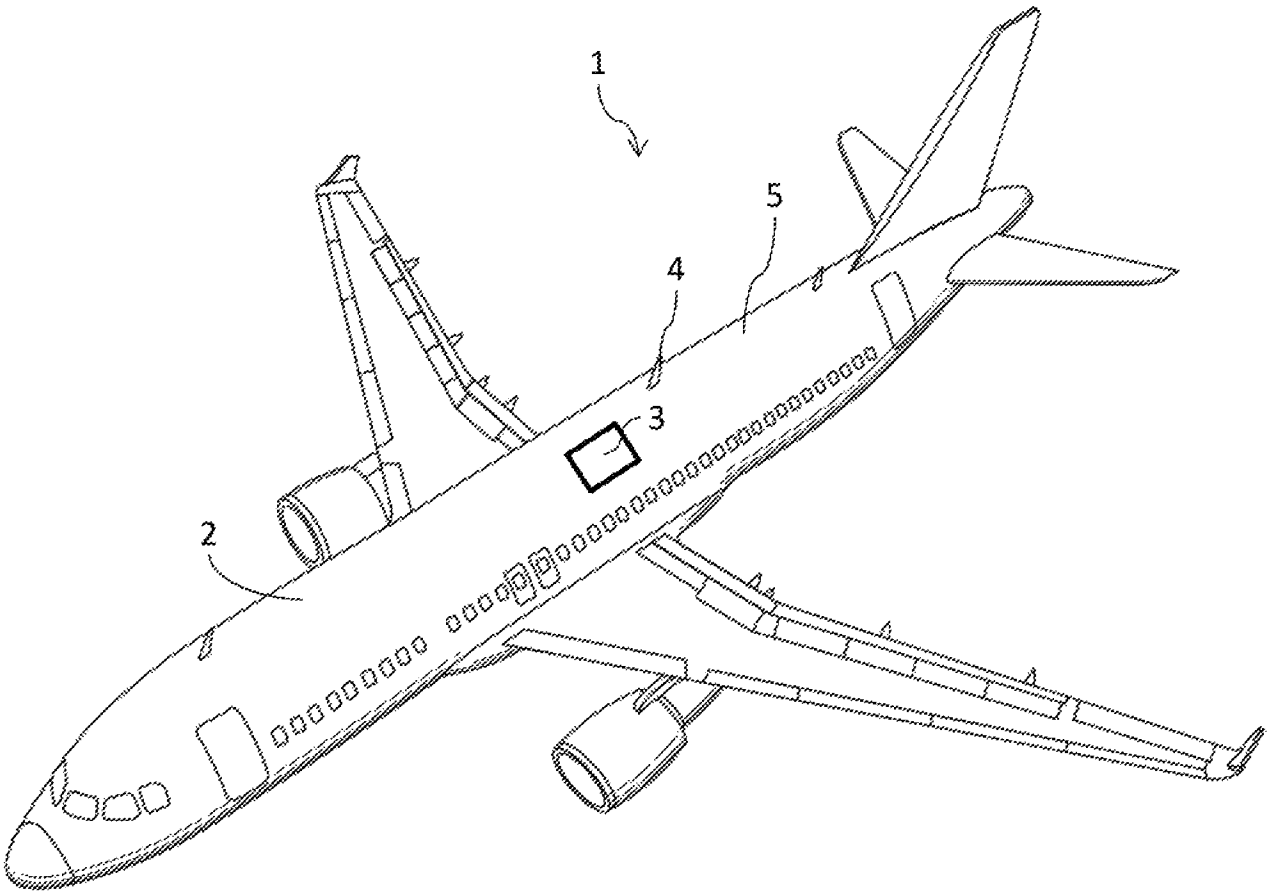
FIG. 1 shows a schematic perspective view of an aircraft having an antenna assembly according to the invention.

The aircraft 1 shown in FIG. 1 has a fuselage 2 and an antenna assembly 3 according to an embodiment of the invention. In addition to the antenna assembly 3, conventional blade antennas 4, which are secured externally on the fuselage 2 and project outwards from the fuselage 2, are also shown for purposes of illustration. In contrast, the antenna assembly 3 in the illustrative embodiment shown is configured as a sheet-like and flexible film component and is arranged from the outside on a section of the outer skin 5 of the fuselage 2. In this way, the air resistance of the fuselage 2 is increased insignificantly or not at all by the antenna assembly 3. In FIG. 1, the antenna assembly 3 is arranged on the upper side of the fuselage 2, by way of example. However, it is also possible for the antenna assembly to be situated at any other point on the fuselage 2, e.g. on one side or on the underside or, alternatively, at other points on the aircraft, e.g. a wing or a tailplane.

Figure 2:
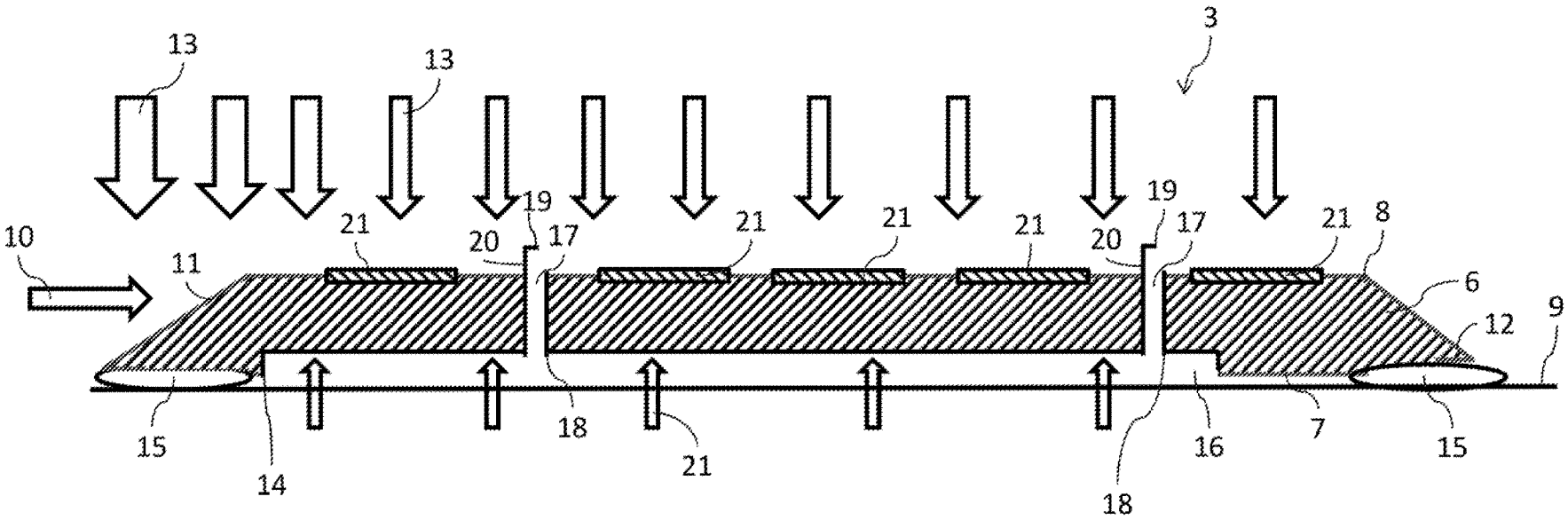
FIG. 2 shows a schematic cross-sectional view of an antenna assembly according to a first illustrative embodiment of the present invention.

The antenna assembly 3, of which a first illustrative embodiment is shown in cross section in FIG. 2, has a support element 6 which is provided in the form of a sheet-like, flexible film or of a sheet-like, flexible film component, which can have a thickness of 1 to 5 cm, for example. In the figures, the support element 6 is in each case illustrated with an exaggerated thickness for reasons of illustration. The support element 6 can comprise a layer composed of a flexible material or a plurality of layers composed of one or more flexible materials arranged one on top of the other. The support element 6 has a first surface 7 and a second surface 8, which are provided on opposite sides of the support element 6 and are spaced apart in the thickness direction of the support element 6. The first surface 7 and the second surface 8 are the two extended surfaces of the film or of the film component. The support element 6 is arranged and secured on a section 9 of the outer skin 5 of an aircraft in such a way that the first surface 7 faces the outer skin section 9 and the second surface 8 faces away from the outer skin section 9. In this case, securing is accomplished by means that are not illustrated, only at individual interspaced points, e.g. by adhesive bonding or by means of retaining clips, which extend over the second surface 8 and are secured on both sides of the support element 6 on the outer skin section 9 or on a reinforcing structure situated thereunder.

In particular, the aircraft can be the aircraft 1 which is shown in FIG. 1, and the antenna assembly 3 is then oriented and positioned in such a way, e.g. in the position shown in FIG. 1, that air acts on the support element 6 and the antenna assembly 3 in the direction denoted by the arrow 10 during the flight of the aircraft 1 and flows over these in said direction 10. The leading edge 11 of the support element 6, which faces counter to the direction of flow 10, is bevelled, as is the opposite trailing edge 12 in precisely the same way, in order to achieve favourable flow conditions and to keep to a minimum aerodynamic effects leading to forces on the support element 6 that tend to lift or detach it from the outer skin section 9. Such lifting forces are caused not only by the impact of the flow in the region of the leading edge 11 but especially also by the flow of air over the support element 6 projecting from the outer skin section 9, which exerts a suction effect on the support element 6, said effect acting upwards in FIG. 2. This is indicated in FIG. 2 by the arrows 13, the respective thickness of which indicates the strength of the force exerted on the support element by the ambient pressure. It can be seen that these forces are very much higher in the region of the leading edge 11 than in the remaining area of the support element 6. In the region of the leading edge 11, the upward pressure is greater than the ambient pressure owing to the deflection of the air flow and can amount to 200% of the ambient pressure, for example, while the pressure in the remaining area of the support element 6 is lower than the ambient pressure and can amount to 50% of the ambient pressure, for example, with the result that a lifting force is exerted on the support element 6.

A recess 14 is formed in the first surface 7, and an encircling sealing ring 15 is arranged in the edge region of the support element 6, between the first surface 7 and the outer skin section 9. A cavity 16 corresponding substantially to the recess 14 is thereby formed between the first surface 7, the outer skin section 9 and the sealing ring 15. The sealing ring 15 can be configured in such a way that the first surface 7 rests against the outer skin section 9 outside the recess 14, with the result that the cavity 16 corresponds to the recess 14. In all cases, air can escape from the cavity 16 or recess 14 into the environment only via two flow channels 17, which extend through the support element 6 in the thickness direction. At one end, each of the flow channels 17 has a first opening 18, which opens into the recess 14 or cavity 16 and, at the opposite end, has a second opening 19, which opens into the environment. Here, the second opening 19 is provided on a rigid line section 20, which projects from the second surface 8 and in which part of the corresponding flow channel 17 runs.

As with the principle of a water jet pump, the flow of air over the support element 6 and the antenna assembly 3 during the flight of the aircraft 1 causes a suction effect at the second openings 19, sucking air out of the recess 14 or cavity 16 through the flow channels 17 and in this way producing a reduced pressure there between the second surface 7 and the outer skin section 9. This reduced pressure is lower than the pressure 13 acting on the first surface 8, as indicated by the arrows 21. As a result, a force on the support element 6 acting downwards overall in FIG. 2 arises in the region of the recess 14 or cavity 16, pressing the support element 6 and the antenna assembly 3 against the outer skin section 9 and thus representing a retaining force counteracting the lifting forces. This retaining force is produced by the same flow as the lifting forces and increases proportionally thereto, for example. The requirements on any other fastening of the support element 6 on the outer skin section 9 are therefore significantly reduced. Thus, for example, it is possible to dispense with full-area adhesive bonding between the support element 6 and the outer skin section 9.

In the illustrative embodiment shown, the second opening 19 is oriented in such a way in the direction of flow 10 that a particularly high suction effect can be achieved by means of air turbulence at the support element 6 and the line section 20. The arrangement and orientation of the second openings 19 can be selected in a flexible manner in such a way that a suitable high suction effect for the envisaged use and for a predetermined direction of overflow 10 is achieved at the second openings 19.

Figure 3:
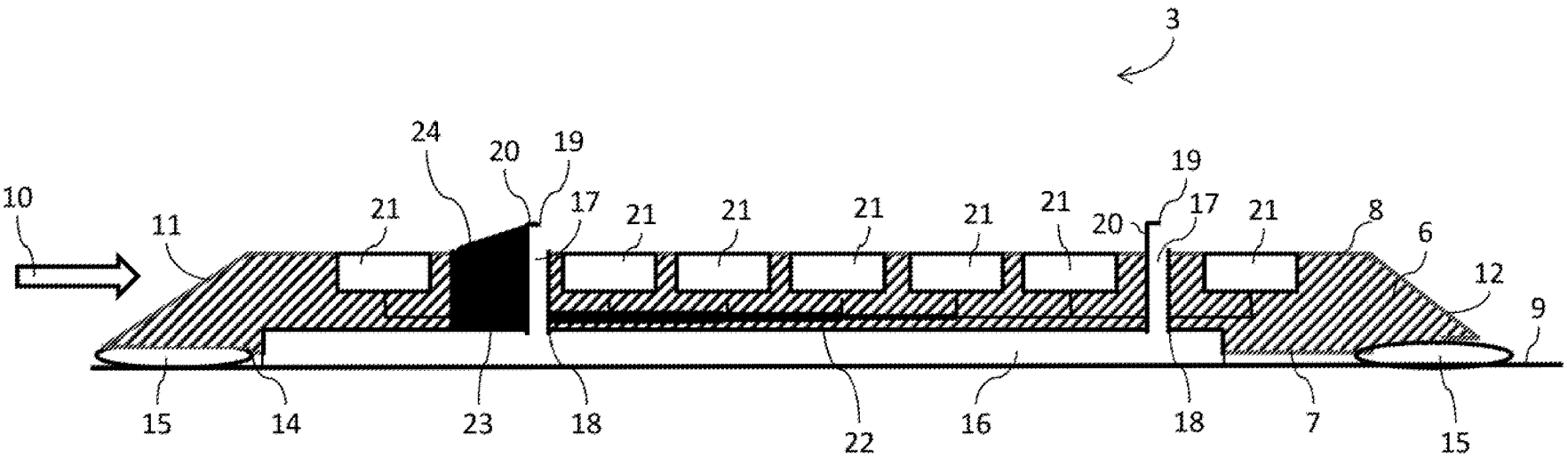
FIG. 3 shows a schematic cross-sectional view of an antenna assembly according to a second illustrative embodiment of the present invention.
Figure 5:
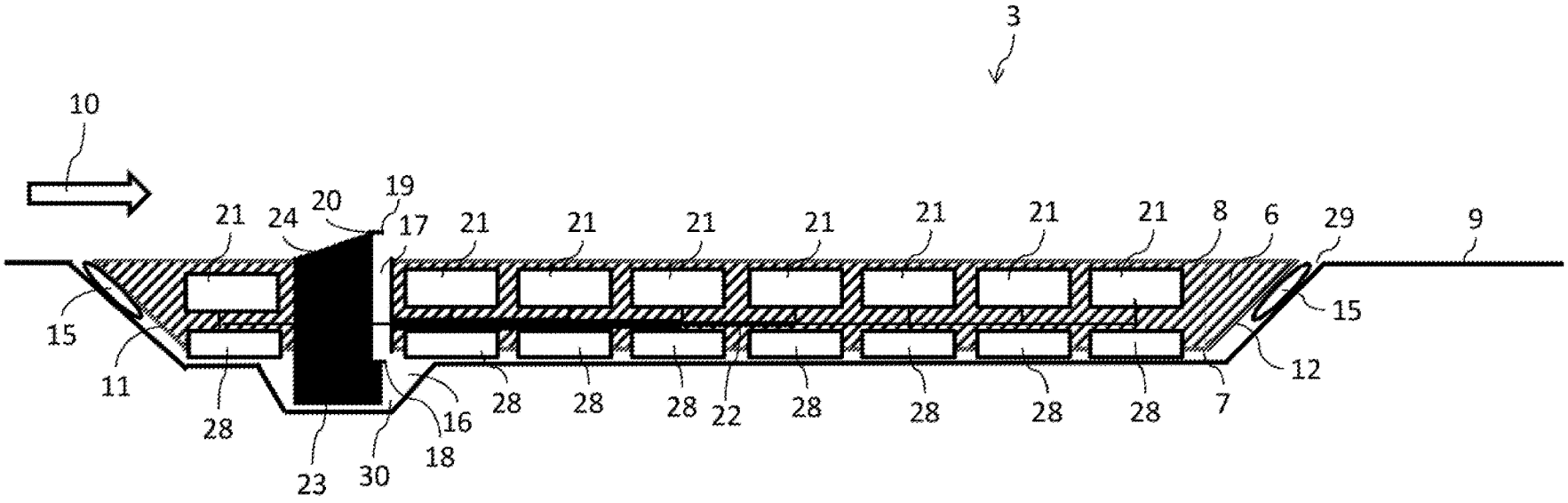
FIG. 5 shows a schematic cross-sectional view of an antenna assembly according to a fourth illustrative embodiment of the present invention.

A multiplicity of antenna elements 21 in the form of patch antennas is printed onto the second surface 8 of the support element 6, and electric feed lines 22 for the patch antennas 21 can be embedded in the material of the support element 6 (not shown in FIG. 2 but see FIGS. 3 and 5).

A second illustrative embodiment of the antenna assembly 3 is shown in cross section in FIG. 3. This illustrative embodiment is very largely identical to the illustrative embodiment shown in FIG. 2, and therefore only differences will be explained.

The antenna assembly 3 in FIG. 3 has a channel 23, which extends over at least part of the width of the support element 6 and of which one part forms a raised portion 24 projecting from the second surface 8. In the channel 23, it is possible, for example, for there to be electric leads or a fastening clamp, which extends over the entire width of the support element 6 and extends beyond the latter on both sides and can be connected there to the outer skin section 9 or to a reinforcing structure, situated underneath the latter, of the aircraft 1 in order to secure the support element 6 on the outer skin section 9. The raised portion 24 forms an obstacle to the flow flowing over the support element 6 in direction 10, and one of the line sections 20 and the second opening 19 are arranged directly adjacent to and, in the direction of flow 10, behind the raised portion 24. It is thereby possible to improve the suction effect at the second opening 19. The raised portion 24 can have a downward slope in a direction counter to the direction of flow 10 or can have some other suitable shape in order both to keep down an increase in air resistance and to achieve an improvement in the suction effect.

In FIG. 3, the patch antennas 21 are not printed on but are designed as antenna elements let into the second surface 8. They are connected to electric leads in the channel 23 by electric leads 22.

Figure 4:
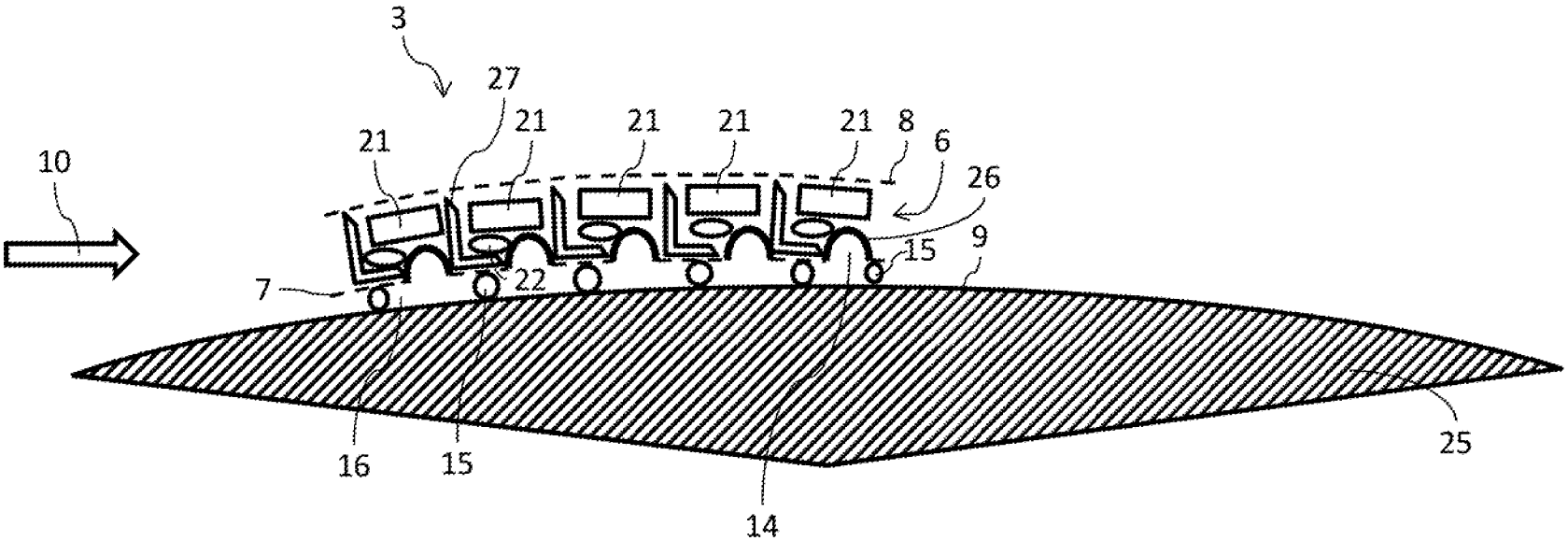
FIG. 4 shows a schematic cross-sectional view of an antenna assembly according to a third illustrative embodiment of the present invention.

FIG. 4 shows an illustrative embodiment of the antenna assembly 3 which can be used inter alia in each of the illustrative embodiments in FIGS. 2, 3 and 5. It can be seen that not only antenna elements 21 and electric leads 22 but also earthing elements 27 are embedded in the material of the support element 6. Moreover, a multiplicity of recesses 14 is provided in the first surface 7, each extending in the form of channels perpendicularly to the plane of the drawing and being separated both from one another and from the environment by suitable seals 15. This gives rise to a plurality of mutually separated cavities 16, for each of which dedicated flow channels 17 for the evacuation thereof are provided. The walls of the recesses 14 are formed by stiff or rigid inserts 26 which, even in the case of very flexible material for the support element 6, ensure that the recesses 14 and the cavities 16 have a defined shape and size. It is nevertheless possible to ensure a flexibility of the overall antenna assembly 3 sufficient to allow adaptation to the curved surface of the outer skin section 9, which can be provided on a fuselage section 25 of the aircraft 1, for example.

A fourth illustrative embodiment of the antenna assembly 3 is shown in cross section in FIG. 5. This illustrative embodiment is a very largely identical to the illustrative embodiment shown in FIG. 3, and therefore only differences will be explained.

In the antenna assembly 3 in FIG. 5, the support element is arranged in a recess 29 in the outer skin section 9, more specifically in such a way that the second surface 8 is flush or substantially flush with the surface of the outer skin section 9 beyond the recess 29. Moreover, no recesses are provided in the first surface 7. On the contrary, the outer skin section 9 has, in recess 29, a further recess 30, into which the first opening 18 of a flow channel 17 opens and into which a lower end of the channel 23 projects. The cavity 16 is formed primarily in the region of this further recess 30 and, to a lesser extent, between the remaining regions of the first surface 7 and the outer skin section 9.

Furthermore, the antenna assembly 3 has a multiplicity of metallic elements 28, which are embedded in the first surface 7 and partially project therefrom. They are in electric and thermal contact with the outer skin section 9, allowing an exchange of heat and electric charge between the antenna assembly 3 and the outer skin section 9.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An antenna assembly for an aircraft, comprising:

a support element having a first and a second surface on opposite sides of the support element;

at least one antenna element arranged on or in the support element; and a sealing device, wherein the first surface and the sealing device are configured in such a way that the antenna assembly is arranged in such a way on an outer skin section of an aircraft that the first surface faces the outer skin section, the sealing device is situated between the support element and the outer skin section, and at least one cavity is defined by the sealing device, the outer skin section and the first surface, and the support element or the sealing device for each of the cavities has at least one flow channel having a first and a second opening at opposite ends of the flow channel, the flow channel connecting the corresponding cavity and the environment of the antenna assembly to one another after the arrangement of the antenna assembly on the outer skin section and opening into the corresponding cavity at the first opening and opening into the environment at the second opening.

2. The antenna assembly according to claim 1, wherein the second opening of at least one of the flow channels is formed on a line section in which part of the flow channel extends and which projects from the support element or the sealing device into the environment after the arrangement of the antenna assembly on the outer skin section.

3. The antenna assembly according to claim 1, wherein the second opening of at least one of the flow channels is formed in the second surface or the sealing device.

4. The antenna assembly according to claim 1, wherein the support element is a sheet-like element.

5. The antenna assembly according to claim 1, wherein the support element is flexible.

6. The antenna assembly according to claim 5, wherein the support element has a rigid insert for each of the recesses, said insert defining the respective recess.

7. The antenna assembly according to claim 1, wherein the first surface has at least one recess, each of which defines one of the cavities after the arrangement of the antenna assembly on the outer skin section.

8. The antenna assembly according to claim 1, wherein each of the at least one antenna elements is a patch antenna and/or a Ku or Ka antenna.

9. The antenna assembly according to claim 1, wherein each of the at least one antenna elements is printed onto the support element or onto a part thereof.

10. The antenna assembly according to claim 1, wherein the second surface has at least one raised portion, in which at least one electric lead and/or at least one fastening element is arranged or which is formed by at least one electric lead and/or at least one fastening element, and wherein the second opening of at least one of the flow channels is arranged on the raised portion or directly adjacent to the raised portion.

11. The antenna assembly according to claim 1, wherein one or more thermally or electrically conductive elements, each of which forms part of the first surface or projects from the first surface, is/are provided on or in the support element, with the result that the thermally or electrically conductive elements are in contact with the outer skin section after the arrangement of the support element on the outer skin section.

12. The antenna assembly according to claim 1, further comprising an outer skin section of an aircraft, wherein the support element is arranged on the outer skin section in such a way that the first surface faces the outer skin section, the sealing device is situated between the support element and the outer skin section, and a cavity is defined by the sealing device, the outer skin section and the first surface.

13. The antenna assembly according to claim 12, wherein one or more holes, through which cables are passed or can be passed, is/are provided in the outer skin section, and wherein the holes are arranged outside that region of the outer skin section which is covered by the support element.

14. The antenna assembly according to claim 12, wherein a recess, in which the antenna assembly is arranged, is provided in the outer skin section.

15. An aircraft having an outer skin and an antenna assembly according to claim 1, wherein the support element is arranged in such a way on an outer skin section of the outer skin that the first surface faces the outer skin section, the sealing device is situated between the support element and the outer skin section, and the at least one cavity is defined by the sealing device, the outer skin section and the first surface.

* * * * *